United States Patent [19]

Isoda

[11] 4,426,971

[45] Jan. 24, 1984

[54] FUEL INJECTION RATE LIMITING DEVICE FOR DIESEL ENGINE

[75] Inventor: Mitsumasa Isoda, Sakaishi, Japan

[73] Assignee: Kubota Ltd., Osaka, Japan

[21] Appl. No.: 382,815

[22] Filed: May 28, 1982

[30] Foreign Application Priority Data

Jun. 29, 1981 [JP] Japan ..... 56-96991[U]

[51] Int. Cl.[3] ..... F02D 31/00

[52] U.S. Cl. ..... 123/367; 123/373; 123/366

[58] Field of Search ..... 123/367, 366, 365, 372, 123/373

[56] References Cited

U.S. PATENT DOCUMENTS

| | | | |
|---|---|---|---|
| 3,025,843 | 3/1962 | Wagner et al. | 123/367 |
| 3,234,927 | 2/1966 | Cramer, Jr. | 123/367 |
| 3,942,498 | 3/1976 | Gheim et al. | 123/373 |
| 3,945,360 | 3/1976 | Laufer | 123/373 |
| 4,180,040 | 12/1979 | Hofer et al. | 123/368 |
| 4,223,653 | 9/1980 | Jaenke et al. | 123/366 |

FOREIGN PATENT DOCUMENTS

| | | | |
|---|---|---|---|
| 2023303A | 12/1979 | United Kingdom | 123/366 |

*Primary Examiner*—Ira S. Lazarus

*Assistant Examiner*—Magdalen Moy

*Attorney, Agent, or Firm*—Schwartz, Jeffery, Schwaab, Mack, Blumenthal & Koch

[57] ABSTRACT

A fuel injection rate limiting device for diesel engine aimed at improving engine performance on starting as well as in operation under overload through impartation of an increased tenacity, wherein a limiter means is provided to check a governor lever to thereby limit the fuel injection rate under the full-load condition but at the same time the governor lever is allowed to continue shifting within reason and gradually against a torque spring in such direction as to increase the fuel injection rate so that the fuel injection rate is gradually increased as the engine speed (rpm.) falls under overload. Moreover, on starting of the engine, the governor lever is caused to shift extensively against the torque spring as well as the starting spring in the fuel injection rate increasing direction for improvement of the engine's starting performance. It is also aimed at enabling adjustment with a high precision of the extent of increase of fuel injection rate with engine running under overload as well as on starting and this object is accomplished by providing separate checking means for individual limiting of the retreating strokes of the torque spring and starting spring which are adjustable, again individually, by the respective adjusting screws.

1 Claim, 5 Drawing Figures

PRIOR ART FIG. 1
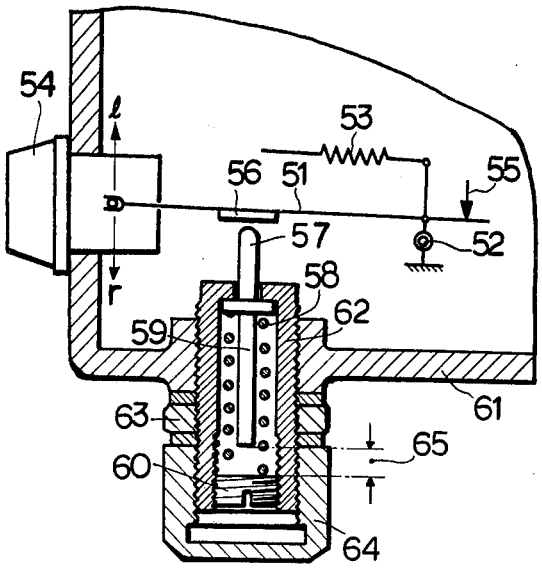
PRIOR ART FIG. 2
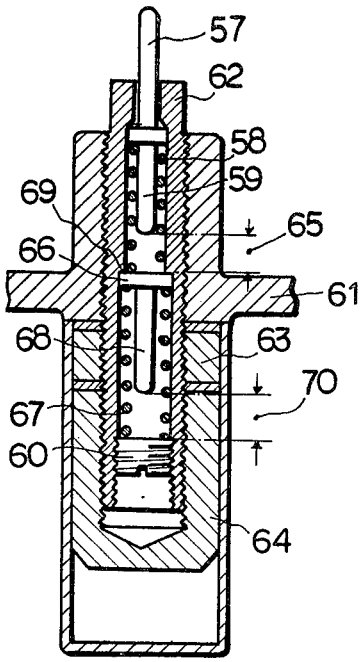
PRIOR ART FIG. 3
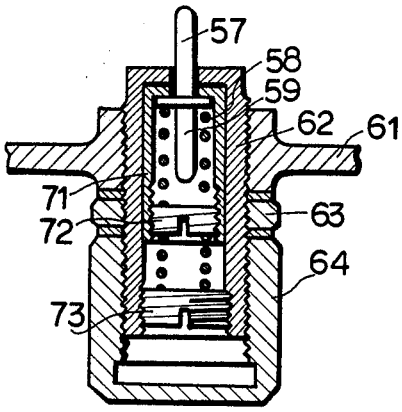
FIG. 5
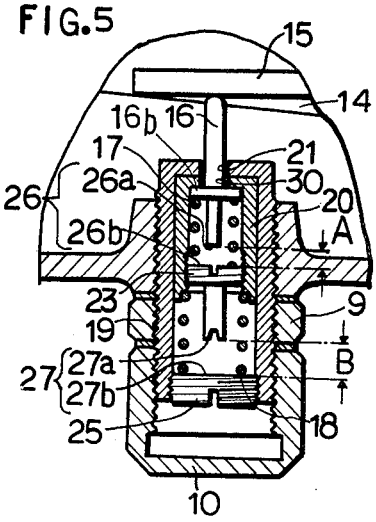

FUEL INJECTION RATE LIMITING DEVICE FOR DIESEL ENGINE

BACKGROUND OF THE INVENTION

1. Field of the Invention

The present invention relates generally to a fuel injection rate limiting device for a diesel engine.

More particularly, it relates to an improved design for such a limiting device, wherein the maximum engine torque for the normal load range is set by means of a limiter which prevents the control element of a governor to shift excessively in the fuel increasing sense and, should the engine speed (rpm.) begin to fall due to overloading, the governor's control element is allowed to shift gradually in the fuel increasing sense against a torque spring to raise the engine torque to avoid stopping of the engine to thus impart a reasonable degree of tenacity to engine operation.

2. Description of the Prior Art

As a like device of prior art is known, among others, one shown in FIG. 1, wherein a governor lever 51 is urged, on the one hand, by a governor spring 53 in the direction indicated by the arrow "r" with a fulcrum shaft 52 as the fulcrum for the fuel injection rate of a fuel injection pump 54 to be increased accordingly and, on the other hand, by a governor force 55 in the direction "l" for said fuel injection rate to be decreased accordingly and the position of the governor lever 51 is determined by the difference between said two opposing urging forces to either increase or decrease the fuel injection rate.

When the engine in operation has been overloaded, the governor force 55 decreases as the engine speed (rpm.) falls and the governor lever 51 is shifted in the fuel increasing direction "r".

Then, first a limitee 56 formed on the governor lever 51 is checked by a limiter 57 and further increase of the fuel injection rate is thereby prevented. If, nevertheless, the governor lever 51 should continue shifting in the same direction, the limitee 56 thereon then starts pushing the limiter 57 to thereby compress a torque spring 58 urging it back gradually for the fuel injection rate to be increased accordingly so that the engine is kept in operation.

If the overload should further continue increasing, with no proper action taken for eliminating its cause, a checker 59 monoblock with the limiter 57 is stopped by a torque adjusting screw 60, the limitee 56 is prevented from further shifting in the direction "r" and, with the fuel injection rate no longer increased, the engine is caused to stall under overload.

Numeral 61 is a crank case or a gear case, 62 a fixed cylinder, 63 a lock nut, 64 a cap nut and indicated by numeral 65 is the stroke (extent) of increase of fuel injection rate under overload.

In the construction shown in FIG. 1 the stroke of fuel increase feasible on cold starting is limited to that of fuel increase under overload 65 and, this being insufficient, the engine's starting performance cannot be satisfactory.

In such a case, required additionally is a special start-assisting arrangement such as a priming device for additionally supplying, separately, an auxiliary fuel for assisting starting to thereby improve the engine's starting performance, and this is unadvantageous in that the engine as a whole becomes more complicated in construction, more bulky and expensive and also the starting procedure is complicated thereby.

For overcoming the abovementioned problems, now known is the construction shown in FIG. 2.

The construction of FIG. 2 represents the following improvements made in the construction shown in FIG. 1. In it there are additionally provided a spring holder 66 and a spring for allowing fuel increase on starting (fuel increase-on-starting spring) 67 between said torque spring 58 and said adjusting screw 60, and a stopper 68 in formed monoblock with the spring holder 66. The fuel increase-on-starting spring 67 is stronger in tension than the torque spring 58, and remains uncompressed even when the torque spring 58 is compressed with the engine running under overload. The spring holder 66 urged as shown by the fuel increase-on-starting spring 67 is checked by the stepped part 69.

On starting of the engine, the governor force 55 is zero, hence the limitee 56 shifts in the fuel-increase direction "r" with an increased force. Hence the torque spring 58 as well as the fuel increase-on-starting spring 67 is compressed for the fuel supply to be increased for starting with its rate corresponding to the sum of the fuel increase stroke under overload 65 and the fuel increase stroke on starting 70, and the engine's starting performance is improved thereby.

This construction of FIG. 2, however, has a drawback that the tension of the torque spring 58 is not adjustable, hence it is impossible to adjust to a proper level the peak torque when the engine speed (rpm.) falls under overload.

In order to further overcome this drawback, the inventor developed the construction shown in FIG. 3 prior to the present invention.

It is so designed that the torque spring 58 alone is compressed when the running engine is overloaded. On starting of the engine, the torque spring 58 is compressed and at the same time also compressed is the fuel increase-on-starting spring 67 with a movable cylinder 71 sliding in the fuel-increasing direction "r" for the fuel injection rate to be increased for starting. The tension of the torque spring 58 is adjustable by means of an adjusting screw 72 and that of the fuel increase-on-starting spring 67 by means of another adjusting screw 73 respectively.

This construction of FIG. 3, however, still has such a drawback as the extent of shifting of the movable cylinder 71 in the fuel-increasing direction "r" on starting of the engine, that is, the fuel-increase stroke on starting 70 is unstable being liable to be too large or too small, this possibly resulting in a failure to sufficiently improve the starting performance due to shortage of fuel or in an imperfect combustion with consequent emission of black smoke and/or waste of fuel due to excessive fuel supply.

SUMMARY OF THE INVENTION

The principal object of the present invention is to provide a fuel injection rate limiting device for sufficient improvement of the diesel engine's starting performance with elimination of emitting of black smoke and waste of fuel, whereby an ample increase of the fuel injection rate on starting of the engine is made possible without the additional necessity of providing a special auxiliary arrangement for starting, and the peak torque when the engine speed (rpm.) falls under overload can be adjusted to a proper level with a high precision as well as the extent of increase of the fuel injection rate on starting the engine.

Aimed at accomplishing this object, the present invention is characterized by the following improvements made in the construction of FIG. 3, the improved construction being as shown in FIG. 5.

As seen from the preferred embodiment shown in FIG. 5, the present invention is characterized in that a stopper means 27 as shown in the figure is provided between the adjusting screw 25 of the fixed cylinder 19 and the adjusting screw 23 of the movable cylinder 20 and that this stopper means 27 serves to determine the stroke (extent) of the increase of fuel injection rate on starting "B", this stroke "B" being easily adjustable with a high precision by means of the adjusting screw 25 of the fixed cylinder 19.

BRIEF DESCRIPTION OF THE DRAWINGS

Of the figures showing fuel injection rate limiting devices for diesel engine:

FIGS. 1 and 2 are horizontal sectional views of like conventional constructions.

FIG. 3 is a horizontal sectional view of the construction developed by the inventor prior to the present invention.

FIG. 5 is a horizontal sectional view of a fuel injection rate limiting device of the present invention.

DETAILED DESCRIPTION OF THE PREFERRED EMBODIMENTS

Figure 4:
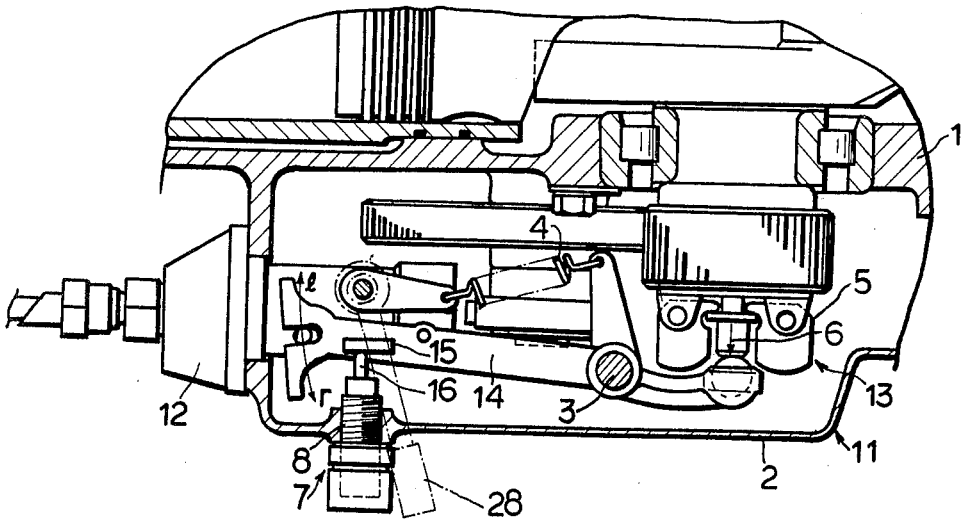
FIG. 4 is a plan view of a governor mechanism for diesel engine as part of the present invention.

Described below under reference to the appended drawings are the preferred embodiments of the present invention.

Shown in FIG. 4 is a governor mechanism 13 of a diesel engine 11, which is basically identical with the conventional example shown in FIG. 1 in construction as well as function.

To the front wall of a crank case 1 a gear case 2 is fixedly attached. In the gear case 2, there is provided a governor lever 14 which, with a fulcrum shaft 3 as fulcrum, is urged by a governor spring 4 adjusted by a throttle lever 28 in the direction "r" for increasing the fuel injection rate of a fuel injection pump 12 and by a governor force 6 of a governor 5 in the opposite direction "l" for decreasing said fuel injection rate respectively with its position determined by the difference therebetween.

When the engine in operation has been overloaded, the governor force 6 decreases as the engine speed (rmp.) falls and the governor lever 14 is shifted in the fuel increasing direction "r" until it is checked by a fuel injection rate limiting device 7 which prevents further increase of the fuel injection rate.

Now described is the construction of the fuel injection rate limiting device 7, referring to FIG. 5.

There is formed a limitee amid the governor lever 14 as a movable control element of the governor mechanism 13 as an integral part thereof. On the fuel-increasing side "r" of the limitee 15 a fixed cylinder 19 is screwed through a mating tapped hole 8 in the gear case 2 longitudinally displaceable, i.e. along the "r"–"l" direction, and locked with a lock nut 9, and on the outside thereof a cap nut 10 is set to close the outer end of the fixed cylinder 19. The gear case 2 has fixedly mounted thereon also a fuel injection pump.

Inside the fixed cylinder 19 there is set a movable cylinder 20 freely slidable substantially along the moving direction of the limitee 15. The front end walls of the movable cylinder 20 and the fixed cylinder 19 have made therein through-holes 21 and 30.

A fuel injection rate limiter 16 extending from inside the movable cylinder 20 is freely slidable through both through-holes 21 and 30 and project beyond the front end wall of the fixed cylinder 19 oppositing the limitee 15. A flange 16*b* formed at the rear end of the limiter 16 monoblock therewith is checked by the front end wall of the movable cylinder 20 so that it cannot be pulled out of the through-holes 21 and 30.

The movable cylinder 20 has a first adjusting screw 23 screwed into the other end portion thereof displaceable longitudinally, and a first spring 17 is loaded between the first adjusting screw 23 and the flange 16*b* of the limiter 16 in the movable cylinder 20, this first spring 17 urging the limiter 16 in the fuel reducing direction "l".

Inside the movable cylinder 20 a first checking pin 26*a* extends from the rear end of the limiter 16 monoblock therewith toward the first adjusting screw 23. The front face of the first adjusting screw 23 opposing the first checking pin 26*a* constitutes a checking plane 26*b*. And the dimension "A" between this checking plane 26*b* and the rear end of the first checking pin 26*a* is the backing stroke or allowance of the limiter 16 toward the first adjusting screw 23, that is, in the fuel-increasing direction "r". Thus, the first checking pin 26*a* and the checking plane 26*b* constitute a first checking means 26.

Rear in the fixed cylinder 19 a second adjusting screw 25 is screwed also displaceable longitudinally. Inside the fixed cylinder 19 a second spring 18 is loaded between the second adjusting screw 25 and the movable cylinder 20.

Inside the fixed cylinder 19 a second checking pin 27*a* extends from the rear face of the first adjusting screw 23 monoblock therewith toward the second adjusting screw 25. The front face of the second adjusting screw 25 oppositing the second checking pin 27*a* constitutes a stopper plane 27*b*. And the dimension "B" between this checking plane 27*b* and the rear end of the second checking pin 27*a* is the backing stroke or allowance of the movable cylinder 20 toward the second adjusting screw 25, that is, in the fuel-increasing direction "r". Thus, the second checking pin 27*a* and the checking plane 27*b* constitute a second checking means 27.

The tension of the first spring 17 is set lower than the force with which the governor mechanism 13 shifts the governor lever 14 in the fuel-increasing direction "r" when the engine in operation is overloaded, and it is used as torque spring, while the second spring 18 is set at a higher tension and is used as starting spring. In this case, the first checking means 26 serves to check an undue rise of torque of the engine running under overload, while the second checking means serves to check an undue increase of fuel injection rate of the engine on starting.

Their functions are now described in detail.

For starting the engine 11, first the throttle lever 28 is set at the "start" position to stretch the governor spring 4. The governor force 6 is then zero, hence the governor lever 4 is strongly urged by the tension of the governor spring 4 in the fuel-increasing direction "r". The limiter 16 is now pushed hard by the limitee 15 on the governor lever 14 in the fuel-increasing direction "r"

and, thereupon, first the torque spring 17 is compressed and then the first checking pin 26*a* first comes into contact with the checking plane 26*b* and then push the movable cylinder 20 in the fuel-increasing direction "r" and the starting spring 18, too, is compressed thereby.

Thus, increase of fuel injection rate on starting is feasible to a large extent corresponding to the sum of the fuel-increase stroke under overload represented by the dimension "A" and the fuel-increase stroke on starting represented by the dimension "B", and the starting performance of the engine 11 is thus improved.

Said dimensions "A" and "B" are adjustable with a high precision by means of the adjusting screws 23 and 25 respectively, hence the extent of fuel increase on starting can be adjusted easily and precisely to a proper level, neither more or less, and thus the engine's starting performance can be improved sufficiently under simultaneous prevention of emission of black smoke and waste of fuel.

When the running engine 11 has been overloaded, the governor force 26 is reduced as the engine speed (rpm.) falls and with its balance with the tension of the governor spring 4 upset, the governor lever 14 is shifted in the fuel-increasing direction "r". Then, the limiter 16 is pushed by the limitee 15 in the direction indicated by the arrow "r", the torque spring 17 is compressed gradually and the fuel injection rate is increased for the engine torque to be increased accordingly.

When, in the course of this, the overload has been relieved as it may be detected by some proper means, the resultant increase of torque restores the engine speed (rpm.) and then, with the governor force 6 increased, the governor lever 14 shifts in the fuel-decreasing direction "l" with resultant stretching of the torque spring 17, the limitee 15 comes off the limiter 16 and the engine 11 resume running under partial load.

The fuel-increase stroke under overload represented by the dimension "A" can be adjusted with a high precision by means of the adjusting screw 23, hence the extent of fuel increase under overload can be adjusted easily and precisely to a proper level and thereby the peak torque under overloading can be set at a proper level accurately, neither too high nor too low.

In the abovementioned embodiment said first checking means 26 may as well be modified as follows.

(1) The checking pin 26*a* is detached from the limiter 16 and is formed to project from the adjusting screw 23.

(2) Instead of the checking plane 26*b* another checking pin is planted on the adjusting screw 23 to oppose the checking pin 26*a* at a distance of the dimension "A".

(3) The checking pin 26*a* is detached from the limiter 16 and is set between the limiter 16 and the adjusting screw 23 slidable longitudinally, that is, inward and outward, within a range of the dimension "A".

(4) The checking pin 26*a* is connected with the limiter 16 by screwing so that the projecting length (dimension) of the checking pin 26*a* from the rear end of the limiter 16 is adjustable.

It is also possible to apply the modifications (1)~(4) described above for the first checking means 26 to the second checking means 27.

What is claimed is:

1. A fuel injection rate limiting device for a diesel engine, including:

a governor mechanism 13 for controlling the fuel injection rate of a fuel injection pump 12 of a diesel engine 11;

a limitee means 15 formed as an integral part of a movable control element 14 of the governor mechanism 13;

a fixed cylinder means 19 fixedly mounted at a given position with respect to said fuel injection pump 12 and on the fuel injection rate increasing side "r" of said limitee means 15;

a movable cylinder means 20 set in said fixed cylinder means 19 freely slidable longitudinally fore and back substantially along the direction of movement of said limitee means 15;

a fuel injection rate limiter means 16 set through through-holes 21 and 30 made in the front end walls of said movable cylinder means 20 and said fixed cylinder means 19 respectively to extend from inside said movable cylinder means 20 freely slidable through said both holes 21 and 30 to project beyond the front end wall of said fixed cylinder means 19 to oppose said limitee means 15;

a first adjusting screw 23 screwed into the rear end portion of said movable cylinder means 20 with its longitudinal position adjustable;

a first spring means 17 loaded between said first adjusting screw 23 and said limiter means 16 in said movable cylinder means 20 urging said limiter means 16 in the fuel injection rate decreasing direction "l";

a first checking means 26 disposed between said first adjusting screw 23 and limiter means 16 in said movable cylinder means 20 to determine the dimension "A" by which said limiter means 16 can retreat toward said first adjusting screw 23 in said fuel injection rate increasing direction "r";

a second adjusting screw 25 screwed into the rear end portion of said fixed cylinder means 19 with its longitudinal position adjustable;

a second spring means 18 loaded between said second adjusting screw 25 and said movable cylinder means 20 in said fixed cylinder means 19 urging said movable cylinder means 20 forward;

a second checking means 27 disposed between said second adjusting screw 25 and said first adjusting screw 23 in said fixed cylinder means 19 to determine the dimension "B" by which said movable cylinder means 20 can retreat toward said second adjusting screw 25 in said fuel injection rate increasing direction "r"; and an arrangement wherein the tension of either of said first spring means 17 and said second spring means 18 is set lower than the force with which said movable control element 14 of said governor mechanism 13 is shifted in said fuel injection rate increasing direction "r" to be used as torque spring, while the other spring means is set at a higher tension to be used as starting spring.

* * * * *